US012571073B2

(12) United States Patent
Takigami et al.

(10) Patent No.: US 12,571,073 B2
(45) Date of Patent: Mar. 10, 2026

(54) ALUMINUM BRONZE ALLOY AND SLIDING MEMBER USING SAID ALLOY

(71) Applicant: OILES CORPORATION, Fujisawa (JP)

(72) Inventors: Kenji Takigami, Fujisawa (JP); Masafumi Kugo, Fujisawa (JP)

(73) Assignee: OILES CORPORATION, Fujisawa (JP)

( * ) Notice: Subject to any disclaimer, the term of this patent is extended or adjusted under 35 U.S.C. 154(b) by 0 days.

(21) Appl. No.: 18/836,325

(22) PCT Filed: Feb. 28, 2023

(86) PCT No.: PCT/JP2023/007258
§ 371 (c)(1),
(2) Date: Aug. 6, 2024

(87) PCT Pub. No.: WO2023/167170
PCT Pub. Date: Sep. 7, 2023

(65) Prior Publication Data

US 2025/0137096 A1 May 1, 2025

(30) Foreign Application Priority Data

Mar. 1, 2022 (JP) ..... 2022-031337

(51) Int. Cl.
*C22C 9/01* (2006.01)
*C22F 1/08* (2006.01)

(52) U.S. Cl.
CPC . *C22C 9/01* (2013.01); *C22F 1/08* (2013.01)

(58) Field of Classification Search
CPC ..... C22C 9/01; C22F 1/08
See application file for complete search history.

(56) References Cited

U.S. PATENT DOCUMENTS

| | | | |
|---|---|---|---|
| 7,220,494 | B2 | 5/2007 | Lundberg et al. |
| 10,280,497 | B2 | 5/2019 | Gummert et al. |
| 2012/0121930 | A1 | 5/2012 | Goeransson et al. |

FOREIGN PATENT DOCUMENTS

| | | | | |
|---|---|---|---|---|
| CA | 1033195 A | * | 6/1978 | ..... C22C 9/00 |
| EP | 1279749 A | | 1/2003 | |

(Continued)

OTHER PUBLICATIONS

International Search Report dated May 23, 2023, for PCT/JP2023/007258, 5 pages.

(Continued)

*Primary Examiner* — Taiwo Oladapo
(74) *Attorney, Agent, or Firm* — Nixon & Vanderhye P.C.

(57) ABSTRACT

The present invention provides an aluminum bronze alloy excellent in both of the corrosion resistance (suppression of precipitation of a β phase) and the wear resistance (security of the hardness of the metal at a certain level or higher) and capable of being stably manufactured. The present invention also provides a sliding member using the aluminum bronze alloy and having the corrosion resistance, the wear resistance and the stability during manufacture. The aluminum bronze alloy of the present invention is composed of copper (Cu), aluminum (Al), nickel (Ni), iron (Fe) silicon (Si), and inevitable impurities, and has a structure composed of an α phase, a coarse Fe—Si-based intermetallic compound of 1 μm or larger, an infinitesimal κ phase different from the Fe—Si-based intermetallic compound, and a trace amount of inevitable phases.

11 Claims, 6 Drawing Sheets

(56) References Cited

FOREIGN PATENT DOCUMENTS

| | | | |
|---|---|---|---|
| JP | S5147519 | B2 | 12/1976 |
| JP | S52138014 | A | 11/1977 |
| JP | S61257444 | A | 11/1986 |
| JP | H07317804 | A | 12/1995 |
| JP | H0913133 | A | 1/1997 |
| JP | 2007504358 | A | 3/2007 |
| JP | 2009504921 | A | 2/2009 |
| JP | 2017515974 | A | 6/2017 |

OTHER PUBLICATIONS

Written Opinion of the International Searching Authority dated May 23, 2023, for PCT/JP2023/007258, 4 pages.

* cited by examiner

ALUMINUM BRONZE ALLOY AND SLIDING MEMBER USING SAID ALLOY

CROSS-REFERENCE TO RELATED APPLICATIONS

This application is the U.S. national phase of International Application No. PCT/JP2023/007258 filed Feb. 28, 2023 which designated the U.S. and claims priority to JP 2022-031337 filed Mar. 1, 2022, the entire contents of each of which are hereby incorporated by reference.

TECHNICAL FIELD

The present invention relates to an aluminum bronze alloy, and relates to a sliding member using the alloy.

BACKGROUND ART

Practical aluminum bronze alloys are classified into four kinds of CAC701 to CAC704 in Japanese Industrial Standards (JIS), and are constituted of, with respect to the total weight, 7 to 10% by weight of aluminum (Al), 0.5 to 4.5% by weight of nickel (Ni), 0.5 to 5% by weight of iron (Fe), 0.1 to 2% by weight of manganese (Mn) and the balance being copper (Cu) and inevitable impurities. The aluminum bronze alloys are, from the viewpoint of chemical and mechanical properties such as corrosion resistance, seawater resistance and wear resistance, often used in industrial applications such as chemical industry parts, marine vessel parts and machine parts. In particular, an aluminum bronze alloy represented by CAC703 constituted of, with respect to the total weight, 8.5 to 10.5% by weight of Al, 3 to 6% by weight of Ni, 3 to 6% by weight of Fe, 0.1 to 1.5% by weight of Mn and the balance being Cu and inevitable impurities is excellent in corrosion resistance and used as bearings for seawater.

Patent Literature 1 discloses an aluminum bronze alloy excellent in acid resistance and corrosion resistance. The aluminum bronze alloy disclosed in Patent Literature 1 is constituted of, with respect to the total weight, 3 to 12% by weight of Al, 4 to 7% by weight of Ni, 3 to 6% by weight of Fe, 0.3 to 5.0% by weight of silicon (Si) and the balance being copper (Cu) and inevitable impurities. The aluminum bronze alloy disclosed in Patent Literature 1 is excellent in acid resistance and corrosion resistance, and is therefore used mainly for members of acidic cleaning apparatuses.

Patent Literature 2 discloses an aluminum bronze alloy for synchronizer rings excellent in wear resistance. The aluminum bronze alloy disclosed in Patent Literature 2 is constituted of, with respect to the total weight, 7.5 to 9.5% by weight of Al, 7 to 11% by weight of Ni, 7.0 to 9.5% by weight of Fe, 1 to 4% by weight of Si and the balance being copper (Cu) and inevitable impurities. The aluminum bronze alloy disclosed in Patent Literature 2 is excellent in wear resistance and also has high friction coefficient, and is therefore suitable as synchronizer ring members.

Addition of tin (Sn) to conventional aluminum bronze alloys is known to improve the sliding performance. The aluminum bronze alloys containing Sn added therein are excellent in corrosion resistance, and are therefore used for bearing bushes, sliding shoes, worm gears, shaft bearings for turbochargers, and the like (for example, Patent Literature 3).

CITATION LIST

Patent Literature

Patent Literature 1: Japanese Patent Laid-Open No. 51-47519

Patent Literature 2: EP Patent Application Publication No. 1279749

Patent Literature 3: Japanese Translation of PCT International Application Publication No. 2017-515974

SUMMARY OF INVENTION

Technical Problem

However, a problem of conventional aluminum bronze alloys (in particular, even CAC703, excellent in corrosion resistance) is that these alloys cannot have both of the high-load resistance and the wear resistance in seawater regions simultaneously. The aluminum bronze alloy described in Patent Literature 1 has a problem with wear resistance, and is difficult to use as sliding members. The aluminum bronze alloy described in Patent Literature 2 has a problem with corrosion resistance, and is difficult to use in seawater or in an environment rich in chemical activity.

In order to enhance the high-load resistance and improve the wear resistance, hardening of the structure of aluminum bronze alloys is conceivably. In the structure, there are β phases hard as compared with other phases, and when the β phase is precipitated in the structure, the aluminum bronze alloys generally become hard. However, when the amount of β phase increases in the aluminum bronze alloys, metal corrosion is liable to be generated. In water, particularly in seawater, metal corrosion is remarkably generated, and the function the aluminum bronze alloys have is impaired with the lapse of time.

The aluminum bronze alloy containing Sn added therein described in Patent Literature 3 has excellent sliding performance and wear resistance. In the aluminum bronze alloy containing Sn added therein, however, there is a problem of being easily damaged in metalworking, and in particular, in centrifugal and sand mold casting of large-diameter members, casting defects are generated and stable manufacture is difficult.

Therefore, from the viewpoint of suppressing precipitation of the β phase and making the structure (base phase) of the aluminum bronze alloys harder, phases of part of the structure need to be constituted of other phases other than the β phase, and the structure needs to be made hard. In order to harden the phases of part of the structure, elements constituting the aluminum bronze alloy and amounts of the constituting elements need to be adjusted. Further from the viewpoint of enhancing the stability in manufacture, without adding Sn, amounts of Al and/or Ni need to be adjusted.

In order to solve the above problem, an object of the present invention is to provide an aluminum bronze alloy which is excellent in both of the corrosion resistance (suppression of precipitation of the β phase) and the wear resistance (security of the hardness of the metal at a certain level or higher), and can be manufactured stably. Another object of the present invention is to provide a sliding member which uses the aluminum bronze alloy, and has the corrosion resistance, the wear resistance, and the stability in manufacture.

Solution to Problem (1)

An aluminum bronze alloy of the present invention comprises copper (Cu), aluminum (Al), nickel (Ni), iron (Fe), silicon (Si), and inevitable impurities, wherein, with respect to a total weight, Al is 9.5% by weight or more and 10.5% by weight or less;

Ni is 6.0% by weight or more and 8.0% by weight or less;

Fe is 4.0% by weight or more and 6.0% by weight or less;

Si is 1.0% by weight or more and 2.0% by weight or less; and the balance is Cu and the inevitable impurities, and the aluminum bronze alloy has a structure composed of an & phase, a coarse Fe—Si-based intermetallic compound having a length in the short direction of 1 μm or longer, an infinitesimal κ phase different from the Fe—Si-based intermetallic compound and having a length in the short direction of shorter than 1 μm, and a trace amount of inevitable phases;

the coarse Fe—Si-based intermetallic compound accounts for 4% or higher and 14% or lower with respect to an entire structure in terms of area ratio in a cross-section of the metal; and the infinitesimal κ phase is formed dottedly and/or linearly and dispersed in the entire structure.

According to the aluminum bronze alloy of such a constitution, since the precipitation of a β phase is suppressed, the corrosion resistance of the metal is improved. Further since the coarse Fe—Si-based intermetallic compound is precipitated in a certain proportion in the structure and the infinitesimal κ phase different from the Fe—Si-based intermetallic compound is dottedly and/or linearly dispersed in the entire structure, the hardness of the metal is secured. Therefore, when the aluminum bronze alloy is used as a sliding member, the high-load resistance and the wear resistance are improved. Further since no Sn is added, defects in manufacture can be reduced and stable manufacture can be carried out.

(2)

In the aluminum bronze alloy of the present invention, it is preferable that with respect to the total weight, Al is 9.5% by weight or more and 10.5% by weight or less;

Ni is more than 7.0% by weight and 8.0% by weight or less;

Fe is 4.0% by weight or more and 6.0% by weight or less;

Si is 1.0% by weight or more and 2.0% by weight or less; and the balance is Cu and inevitable impurities.

According to the aluminum bronze alloy of such a constitution, since the precipitation of the β phase is suppressed more than in the aluminum bronze alloy described in (1), the corrosion resistance of the metal is more improved. Further since the infinitesimal κ phase different from the coarse Fe—Si-based intermetallic compound in the structure increases as compared with in the aluminum bronze alloy described in (1), and the hardness of the structure is improved, therefore in the case of use as a sliding member, the high-load resistance and the wear resistance of the sliding member are improved.

(3)

In the aluminum bronze alloy of the present invention, it is preferable that the Rockwell hardness is HRC17 or higher.

According to the aluminum bronze alloy of such a constitution, since the Rockwell hardness is HRC17 or higher, the aluminum bronze alloy exhibits excellent wear resistance, and the function of members using the alloy can be retained for a long period. In the case of use as a sliding member, the high-load resistance and the wear resistance of the sliding member are improved.

(4)

In the aluminum bronze alloy of the present invention, it is preferable that the maximum dealuminated corrosion depth based on a corrosion test method according to ISO6509-1981 is 120 μm or smaller.

According to the aluminum bronze alloy of such a constitution, since the maximum dealuminated corrosion depth is 120 μm or smaller, it becomes difficult for the metal to corrode and the corrosion resistance is in turn improved. Therefore, with regard to the performance of the aluminum bronze alloy of such a constitution, even in the environment rich in chemical activity for the metal, for example, in seawater, the function as the aluminum bronze alloy is retained for a long period.

(5)

The sliding member of the present invention is a sliding member having a sliding surface formed of the aluminum bronze alloy described in any one of the above (1) to (4).

According to the sliding member of such a constitution, since the sliding surface is formed of the aluminum bronze alloy excellent in the corrosion resistance and the wear resistance, the sliding performance of the sliding member is retained for a long period.

(6)

In the sliding member of the present invention, it is preferable that a plurality of holes, grooves or recesses are formed on the sliding surface, and a solid lubricant is embedded and fixed in the holes, grooves or recesses.

According to the sliding member of such a constitution, since in part of the sliding surface, the solid lubricant is embedded and fixed, the wear resistance of the sliding member is more improved due to the excellent corrosion resistance and wear resistance of the aluminum bronze alloy and a low frictional property of the solid lubricant.

(7)

In the sliding member of the present invention, it is preferable that part of or an entirety of the sliding member is used in seawater.

According to the sliding member of such a constitution, since the sliding surface is formed of the aluminum bronze alloy excellent in the corrosion resistance and the wear resistance, even if the sliding member is used in seawater, wear and corrosion are suppressed and the sliding performance of the sliding member is retained, for a long period.

DESCRIPTION OF EMBODIMENTS

The following description is the description of embodiments of the present invention, and will be made with reference to the accompanying drawings.

Figure 1:
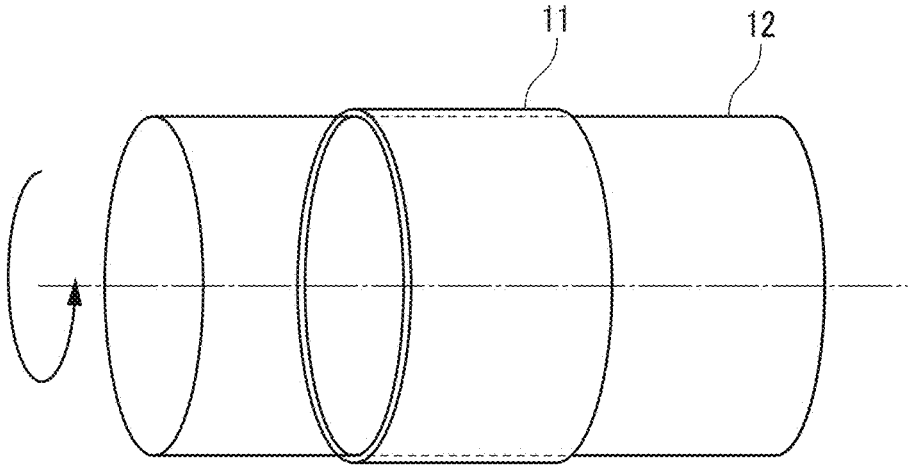
FIG. 1 is a schematic view of the sliding member of the present invention.

A sliding member as one embodiment of the present invention is any sliding parts such as bearings, shafts, sliders, slider holders, gears or washers, or combinations of these sliding parts. As shown in FIG. 1, a sliding member as one embodiment of the present invention is described by a plain bearing 11 formed into a substantially cylindrical shape. Into the inner side of the plain bearing 11, a shaft 12 in a substantially cylindrical shape having nearly the same diameter as the inner diameter of the plain bearing 11 is inserted coaxially. The shaft 12 and/or the plain bearing 11 horizontally moves in the axis direction, or rotationally moves or oscillatorily moves around the axis in the axis direction.

As described later, at least a part of the inner side surface of the plain bearing 11 (a sliding surface of a sliding member) is formed of an aluminum bronze alloy as one embodiment of the present invention by a predetermined method. The entire surface of the inner side surface of the plain bearing 11 may be formed of the aluminum bronze alloy, or the inner side surface of the plain bearing 11 may be formed, partially in the peripheral direction and/or in the axis direction, of the aluminum bronze alloy. The entirety of the plain bearing 11 may be formed of the aluminum bronze alloy, or a layer of the aluminum bronze alloy may be formed on the inner side of a cylindrical member formed of a metallic material or a nonmetallic material. Depending on required sliding performance, there may be added a solid lubricant such as graphite, resin or lead and/or a lubricant such as a lubricating oil or grease. Then, for the shaft 12, a predetermined metallic material or a nonmetallic material is utilized. One embodiment of the present invention uses SUS630, but the material is not limited thereto, and according to required sliding performance including material strength and corrosion resistance and the use condition, a predetermined metallic material or a nonmetallic material may be utilized.

In one embodiment of the present invention, the plain bearing 11 has been exemplified as a sliding member, but the sliding member is not limited thereto. The shaft 12 may constitute the sliding member of the present invention by forming at least a part of the outer side surface of the shaft 12 (sliding surface) of the aluminum bronze alloy. Further, at least a part of the outer side surface of the shaft 12 and at least a part of the inner side surface of the plain bearing 11 each may be formed of the aluminum bronze alloy.

The sliding member of one embodiment of the present invention has been exemplified as a shape of a plain bearing, but the sliding member of the present invention is not limited thereto. As described above, the sliding member of the present invention is any sliding parts such as bearings, shafts, sliders, slider holders, gears or washers, or combinations of these sliding parts in which a part of or the entirety of the sliding surface is formed of the aluminum bronze alloy described later. For example, in the case where the sliding member is a washer, the entirety of the washer or a part of or the entirety of the sliding surface (contact surface) of the washer is formed of the aluminum bronze alloy of the present invention. For example, in the case where the sliding member is a slider or a slider holder, the sliding member is formed into a substantially plate shape. At this time, the entirety of the nearly plate-shape sliding member may be the aluminum bronze alloy, or only the sliding surface which is one surface of the substantially plate-shape sliding member may be formed of the aluminum bronze alloy.

On the sliding surface of the plain bearing 11 as the sliding member of one embodiment of the present invention, a plurality of holes, grooves or recesses are formed, and a solid lubricant composed of graphite, wax or the like is embedded and fixed in the holes, grooves or recesses. By this constitution, the sliding performance of the sliding member can be improved, but the constitution may be omitted according to required sliding performance. The plurality of holes, grooves or recesses are formed by drilling or cutting using a drill or an end mill, but may be formed by other means. At this time, the shape, the size, and the area proportion with respect to the entirety of the sliding surface, and the fixing positions of the plurality of holes, grooves or recesses are optionally selected according to desired sliding performance and applications. For example, the shape, the size, the area proportion and the fixing positions of the plurality of holes, grooves or recesses may be selected as described in Japanese Patent No. 5616032, or may be selected in a range apparent to those skilled in the art.

The plain bearing 11 as the sliding member of one embodiment of the present invention is, since being excellent in the corrosion resistance as described later, used in various environments. The sliding member as one embodiment of the present invention is used, in particular, in seawater. However, the sliding member of the present invention is not limited to use in seawater, and can be used also in environments other than seawater. For example, the sliding member of the present invention is used also in a high-temperature environment and the like.

The aluminum bronze alloy constituting at least a part of the sliding surface of the sliding member as one embodiment of the present invention is an aluminum bronze alloy composed of Cu, Al, Ni, Fe, Si and inevitable impurities, in which with respect to the total weight, Al is 9.5% by weight or more and 10.5% by weight or less; Ni is 6.0% by weight or more and 8.0% by weight or less; Fe is 4.0% by weight or more and 6.0% by weight or less; Si is 1.0% by weight or more and 2.0% by weight or less; and the balance is Cu and inevitable impurities. Then, the aluminum bronze alloy has a structure composed of an a phase, a coarse Fe—Si-based intermetallic compound having a length in the short direction of 1 μm or longer, an infinitesimal κ phase being different from the Fe—Si-based intermetallic compound and having a length in the short direction of shorter than 1 μm, and a trace amount of inevitable phases, wherein the coarse Fe—Si-based intermetallic compound accounts for 4% or higher and 14% or lower with respect to the entire structure in terms of area ratio in the cross-section of the metal; and the infinitesimal κ phase is formed dottedly and/or linearly and dispersed in the entire structure.

The aluminum bronze alloy constituting at least a part of the sliding surface of the sliding member as one embodiment of the present invention can provide excellent wear resistance by precipitating a coarse Fe—Si-based intermetallic compound in amounts in the above ranges by adding Fe and Si in amounts in the above ranges to an alloy composition and adjusting Ni and Al in amounts in the above ranges. At this time, although it is preferable that the sliding member has a Rockwell hardness of HRC17 or higher, the Rockwell hardness is not limited thereto, and may be selected to a predetermined hardness according to the sliding performance and the use condition. Then, by adding Al and Ni in amounts in the above ranges to an alloy composition, the aluminum bronze alloy constituting at least a part of the sliding surface of the sliding member as one embodiment of the present invention is further suppressed in precipitation of a β phase and improved in the corrosion resistance of the metal. At this time, it is preferable that the maximum dealuminated corrosion depth based on a corrosion test method according to ISO6509-1981 is 120 μm or smaller.

A method for manufacturing the aluminum bronze alloy constituting at least a part of the sliding surface of the sliding member as one embodiment of the present invention is not especially limited, but it is preferable that copper nuggets, Al shots, and master alloys of Fe50Al, Cu30Ni and Cu15Si are weighed so as to become desired masses, melted by a high frequency melting furnace and cast by continuous casting, centrifugal casting, sand mold casting or the like.

In the aluminum bronze alloy constituting at least a part of the sliding surface of the sliding member as one embodiment of the present invention, pure metal materials and alloy materials that are materials therefor are copper nuggets, Al shots, and Fe50Al, Cu30Ni and Cu15Si, but are not limited thereto. Predetermined pure metal materials and alloy materials are weighed and can be used so that, with respect to the total weight, Al is 9.5% by weight or more and 10.5% by weight or less; Ni is 6.0% by weight or more and 8.0% by weight or less; Fe is 4.0% by weight or more and 6.0% by weight or less; Si is 1.0% by weight or more and 2.0% by weight or less; and the balance is Cu and inevitable impurities. As the pure metal materials and alloy materials, for example, Fe, Ni, Si, Cu-50Fe and the like can be used.

The method for manufacturing the aluminum bronze alloy constituting at least a part of the sliding surface of the sliding member as one embodiment of the present invention was a method involving melting using a muffle furnace and casting using a predetermined metal mold, but is not limited thereto. As the melting method, a method using a high frequency melting furnace or the like can be used. As the casting method, continuous casting, centrifugal casting, sand mold casting or the like can be used. These means are selected, in order to manufacture a desired sliding member, in a range apparent to those skilled in the art. The melting temperature is not especially limited, and is preferably a temperature at which each of the pure metal materials and alloy materials to be used melts.

In the case where the aluminum bronze alloy constituting at least a part of the sliding surface of the sliding member as one embodiment of the present invention is processed into the above-mentioned sliding member, the sliding member can be formed by using, in casting, a metal mold or a sand mold for manufacturing the sliding member, but the process is not limited thereto. It may be that the aluminum bronze alloy in an optional shape is manufactured by using, in casting, a metal mold or sand mold in an optional shape, and thereafter subjecting the resultant to processes of bending, polishing and/or grinding to thereby form the sliding member.

The present invention is not limited to the above embodiments, and modifications and improvements thereof may be made within the technical idea of the present invention by those ordinarily skilled in the art.

EXAMPLES

Then, examples of the present invention will be described in more detail with reference to experimental results.

In order to manufacture aluminum bronze alloys having compositions indicated in Table 1, each of copper nuggets, Al shots, Fe50Al, Cu30Ni and Cu15Si was weighed so as to become the ratios in the compositions indicated in Table 1, and the resultant was melted at a temperature of 1,200° C. to 1,250° C., and cast in a metal mold to thereby manufacture samples. In melting of aluminum bronze alloys of Examples and Comparative Examples, a flux was added to the molten metal to remove metal oxides, and thereafter, the casting in the metal mold was carried out. The weight of the samples was 300 g or 3,500 g; and samples of 300 g were subjected to measurement of the maximum dealuminated corrosion depth and observation of the metal structure; and samples of 3,500 g were subjected to measurements of the Rockwell hardness (HRC) and the sliding performance.

TABLE 1

| | Cu + Impurities (% by weight) | Al (% by weight) | Ni (% by weight) | Fe (% by weight) | Si (% by weight) |
|---|---|---|---|---|---|
| Example 1 | balance | 9.5 | 6.0 | 4.0 | 1.0 |
| Example 2 | balance | 9.5 | 7.0 | 5.0 | 1.5 |
| Example 3 | balance | 10.0 | 7.0 | 5.0 | 1.5 |
| Example 4 | balance | 10.0 | 8.0 | 6.0 | 2.0 |
| Example 5 | balance | 10.5 | 8.0 | 6.0 | 2.0 |
| Comparative Example 1 | balance | 9.5 | 7.0 | 2.0(*) | 0.5(*) |
| Comparative Example 2 | balance | 9.0(*) | 6.0 | 4.0 | 1.0 |
| Comparative Example 3 | balance | 9.5 | 6.0 | 3.0(*) | 0.8(*) |
| Comparative Example 4 | balance | 10.5 | 8.0 | 6.0 | 2.3(*) |
| Comparative Example 5 | balance | 10.5 | 8.0 | 6.0 | 2.5(*) |
| Comparative Example 6 | balance | 10.5 | 8.0 | 6.5(*) | 2.5(*) |
| Comparative Example 7 | balance | 11.0(*) | 8.0 | 6.0 | 2.0 |

The mark (*) adjacent to a numerical value indicates that the value is out of the numerical value range of the present invention.

Table 2 indicates area proportions of an Fe—Si-based intermetallic compound with respect to the entirety in cross-sectional diagrams of microstructures of aluminum bronze alloys of the present Examples and Comparative Examples. In the cross-sectional diagrams, the area proportions of the Fe—Si-based intermetallic compound were determined as follows. For each aluminum bronze alloy, by using a scanning electron microscope (SEM), the contrast was adjusted so the Fe—Si-based intermetallic compound as to become distinct, and parts of the entire cross-section were photographed as reflection electron images (COMP images) at a magnification of 500 times. At this time, any five image pickup locations in the entire cross-section are selected. For the five reflection electron images (cross-sectional diagrams) of each aluminum bronze alloy, the area proportions of the Fe—Si-based intermetallic compound were measured by using image analysis software (WinROOF, manufactured by Mitani Corp.). Table 2 indicates arithmetic averages of the five area proportions.

TABLE 2

| | Area proportion of Fe—Si-based intermetallic compound with respect to the entirety (% by area) |
|---|---|
| Example 1 | 4.7 |
| Example 2 | 8.9 |
| Example 3 | 8.6 |
| Example 4 | 12.8 |
| Example 5 | 13.2 |
| Comparative Example 1 | 0(*) Fe and Si were contained in base phase as solid solution |
| Comparative Example 2 | 5.1 |
| Comparative Example 3 | 3.5(*) |
| Comparative Example 4 | 13.8 |
| Comparative Example 5 | 14.5(*) |
| Comparative Example 6 | 15.6(*) |
| Comparative Example 7 | 13.2 |

The mark (*) adjacent to a numerical value indicates that the value is out of the numerical value range of the present invention.

Table 3 indicates results of the maximum dealuminated corrosion depths. By using the results of the maximum dealuminated corrosion depths, the comparison of the corrosion resistance could be carried out. Here, the measurement of the maximum dealuminated corrosion depth was carried out based on a corrosion test method according to ISO6509-1981.

TABLE 3

| | Dealuminated corrosion depth μm | |
|---|---|---|
| | Maximum | Average |
| Example 1 | 84 | 63 |
| Example 2 | 92 | 80 |
| Example 3 | 90 | 61 |
| Example 4 | 92 | 59 |
| Example 5 | 120 | 81 |
| Comparative Example 1 | 78 | 65 |
| Comparative Example 2 | 70 | 55 |
| Comparative Example 3 | 82 | 69 |
| Comparative Example 4 | 186(*) | 99 |
| Comparative Example 5 | 241(*) | 118 |
| Comparative Example 6 | 507(*) | 193 |
| Comparative Example 7 | 306(*) | 132 |

The mark (*) adjacent to a numerical value indicates that the value is out of the numerical value range of the present invention.

From the results of Table 3, it was made clear that the maximum dealuminated corrosion depth and an average dealuminated corrosion depth of each of the aluminum bronze alloys (Examples 1 to 5) of the present Examples were lower than those of each of the aluminum bronze alloys (Comparative Examples 4 to 7) of Comparative Examples. Therefore, the aluminum bronze alloys (Examples 1 to 5) of the present Examples had excellent corrosion resistance.

Figure 2:
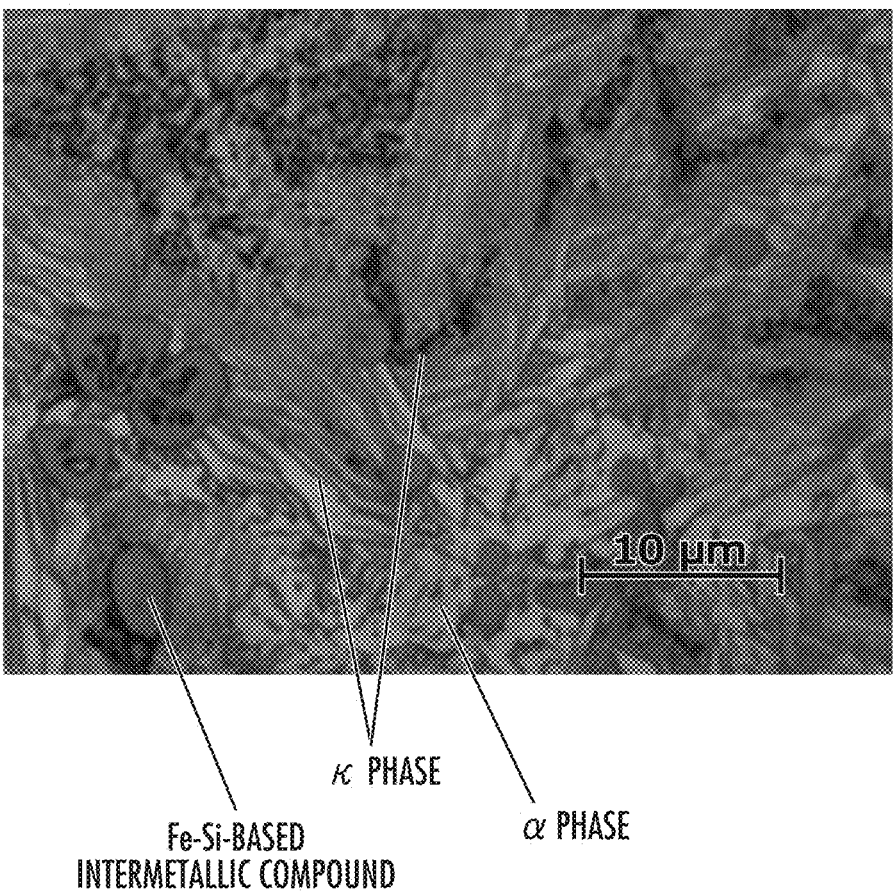
FIG. 2 is an optical microscope photograph showing a microstructure of an aluminum bronze alloy corresponding to Example 2 of the present invention.
Figure 3:
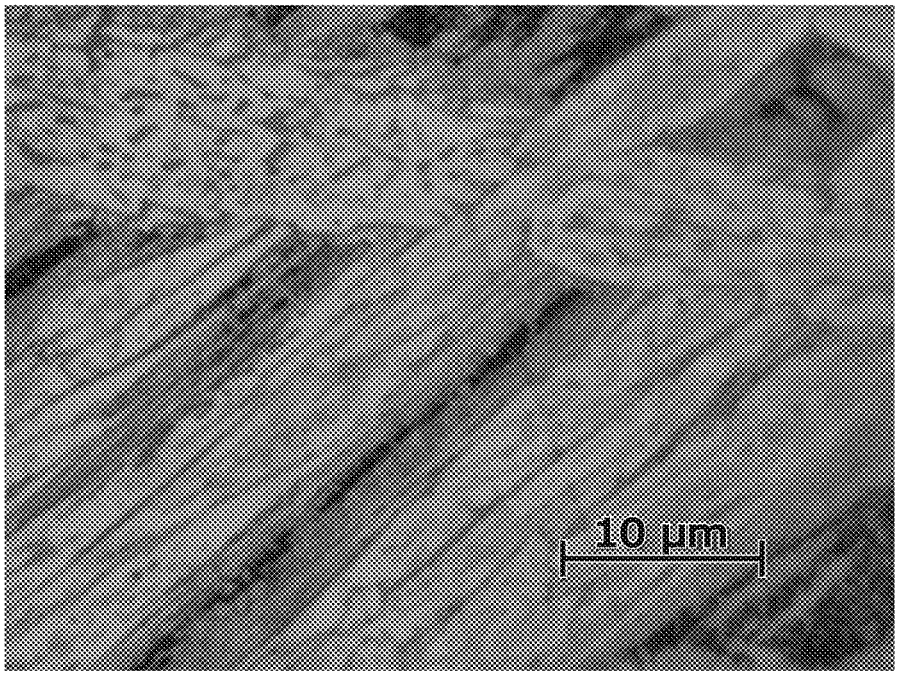
FIG. 3 is an optical microscope photograph showing a microstructure of an aluminum bronze alloy corresponding to Comparative Example 1, which is different from Examples of the present invention.
Figure 4:
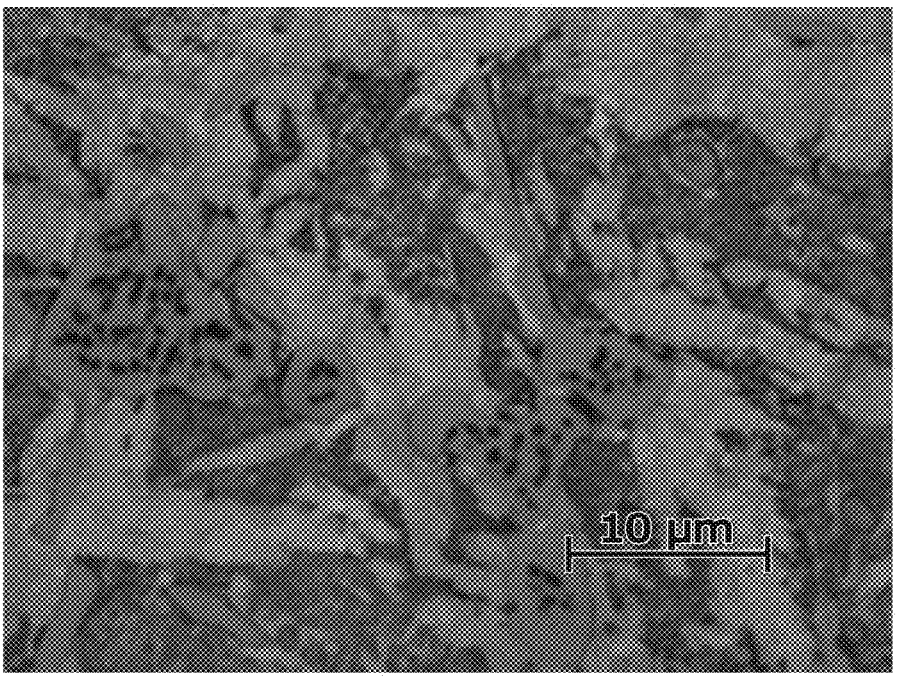
FIG. 4 is an optical microscope photograph showing a microstructure of an aluminum bronze alloy corresponding to Comparative Example 4, which is different from Examples of the present invention.

FIG. 2 to FIG. 4 are optical microscopic photographs showing microstructures of the aluminum bronze alloys of Example 2, Comparative Example 1 and Comparative Example 4, respectively. Here, in order to enhance easiness of discrimination, the figures are shown by adjusting the contrast of the photographs. As representatively shown in FIG. 2, in each figure, regions relatively light in light and darkness were a phases in the aluminum bronze alloy. An a phase is generally a soft structure; and when there are many α phases, the wear resistance and the high-load resistance of the metal are impaired. Further in each figure, regions dark in light and darkness and having a substantially circular shape or a substantially elliptic shape having a length in the short direction of 1 μm or longer were a coarse Fe—Si-based intermetallic compound; and regions dark in light and darkness and having a linear shape or a dotted shape having a length in the short direction of shorter than 1 μm were an infinitesimal κ phase different from the Fe—Si-based intermetallic compound.

As shown in FIG. 2, in the aluminum bronze alloy obtained in Example 2, the coarse Fe—Si-based intermetallic compound was homogeneously dispersed and precipitated. The infinitesimal κ phase different from the Fe—Si-based intermetallic compound was dispersed in the entire structure and constructed a base phase together with the & phase. Besides the α phase, the presence of a β phase in the base phase was supposed; however, due to the small dealuminated corrosion depth (the maximum dealuminated corrosion depth was 120 μm or smaller), it was found that no β phase at all was formed inside the α phase, or the β phase was not present to the degree of impairing the corrosion resistance. Due to the precipitation of the infinitesimal κ phase and the coarse Fe—Si-based intermetallic compound in the base phase, the hardness of the base phase was retained and coarse and hard regions were precipitated in the base phase. Due to this, the coarse intermetallic compound did not easily fall off in sliding and as described later, excellent sliding performance was exhibited. Not shown in figure, but also in Example 1 and Examples 3 to 5, the same state as in Example 2 was exhibited.

By contrast, as shown in FIG. 3, it was found that in the aluminum bronze alloy of Comparative Example 1, the coarse Fe—Si-based intermetallic compound of 1 μm or larger was in a small amount as compared with in Example 2 shown in FIG. 2. Although not shown in figure, also in Comparative Examples 2 and 3, the coarse Fe—Si-based intermetallic compound was in a small amount as in Comparative Example 1. Due to the small amount of coarse Fe—Si-based intermetallic compound and a high proportion of the α phase, in the aluminum bronze alloys of Comparative Examples 1 to 3, the hard intermetallic compound easily fell off in sliding, and thus the sliding performance was greatly impaired as indicated in Table 5 described later. Also the hardness (Rockwell hardness) was low as compared with in Examples 1 to 5, and the wear resistance and the high-load resistance in use as the sliding member decreased.

As shown in FIG. 4, in the aluminum bronze alloy of Comparative Example 4, the coarse Fe—Si-based intermetallic compound was homogeneously dispersed and precipitated. Not shown in figure, but also in Comparative Examples 5 to 7, the same mode was confirmed. On the other hand, in the aluminum bronze alloys of Comparative Examples 3 to 6, from that the dealuminated corrosion depth was large (120 μm or larger), it was supposed that the β phase was formed in the base phase. In the aluminum bronze alloys of Comparative Examples 4 to 7, since the β phase was remarkably formed, as indicated in Table 3, the dealuminated corrosion depth became large as compared with in Examples 1 to 5, and the corrosion resistance and in turn the durability decreased.

In order to measure the sliding performance of sliding members composed of the aluminum bronze alloy of the present invention, a seawater journal test was carried out under the following condition indicated in Table 4, and there were measured the friction coefficient, the wear amount of the bearing and the wear amount of the shaft at this time. Further for comparison, the same test was carried out on Comparative Examples 1 and 2. Each of the sliding members composed of the compositions of Examples 1 to 5 and Comparative Examples 1 and 2 assumed the form of the plain bearing 11 as described in one embodiment of the present invention. The plain bearing 11 was formed in a substantially cylindrical shape. The plain bearing 11 of the present Examples had an inner diameter of 60 mm, an outer diameter of 75 mm and a length of 30 mm. Then, a solid lubricant was embedded in part of the sliding surface of the plain bearing 11 of the present Examples. The solid lubricant used was a PTFE-based solid lubricant SL464 (manufactured by Oiles Corp.).

TABLE 4

| Test environment | In artificial seawater |
|---|---|
| Movement mode | Continuous oscillatory movement of mating shaft |
| Mating material | Material: SUS630<br>Shape: circular column (diameter: 59.9 mm, length: 650 mm) |
| Surface pressure | 90 N/mm$^2$ |
| Oscillatory angle | ±45° |

TABLE 4-continued

| Test environment | In artificial seawater |
|---|---|
| Speed | 6.4 cpm |
| Test time | 50 hr |

The seawater journal test was such a test that, in a state that a shaft 12 was inserted in the plain bearing 11, as shown in FIG. 1, in seawater, the shaft 12 was oscillatorily moved about the central axis of the shaft at a speed indicated in Table 4 while a load in the direction perpendicular to the central axis of the shaft 12 was applied to the plain bearing 11 so that the inner peripheral surface (sliding surface) of the plain bearing 11 pressed the outer peripheral surface of the shaft 12 at a surface pressure indicated in Table 4. The friction coefficient of the plain bearing 11, the wear amount of the bearing and the wear amount of the shaft were measured based on the seawater journal test.

Table 5 indicates the test results of the friction coefficient of the bearing 11, the wear amount of the bearing and the wear amount of the mating shaft in the seawater journal test carried out on the plain bearing 11 composed of the aluminum bronze alloy of each of Examples and Comparative Examples under the condition indicated in Table 4. Table 5 further indicates the Rockwell hardness (HRC) for examining the load resistance as the sliding member. The friction coefficient was a value at the finish of the seawater journal test; and the wear amount of shaft 12 and the wear amount of the plain bearing 11 were also values at the finish of the seawater journal test. At this time, in Example 3, in order to check the sliding performance depending on the lubricating condition, case classification depending on presence/absence of a lubricant was made and the sliding performance was checked. The lubricant utilized was a grease.

TABLE 5

| | Rockwell hardness HRC | Lubrication condition | Friction coefficient at finish | Wear amount of bearing mm | Wear amount of mating shaft mm |
|---|---|---|---|---|---|
| Example 1 | 17.5 | Grease application | 0.13 | 0.033 | 0.002 |
| Example 2 | 19.0 | Grease application | 0.11 | 0.013 | 0.002 |
| Example 3 | 26.0 | No grease | 0.13 | 0.028 | 0.003 |
| Example 3 | 26.0 | Grease application | 0.11 | 0.015 | 0.001 |
| Example 4 | 27.5 | Grease application | 0.11 | 0.013 | 0.002 |
| Example 5 | 31.9 | Grease application | 0.11 | 0.010 | 0.001 |
| Comparative Example 1 | 13.2(*) | Grease application | 0.16 | 0.124 | 0.001 |
| Comparative Example 2 | 11.3(*) | Grease application | 0.16 | 0.087 | 0.002 |
| Comparative Example 3 | 12.5(*) | Grease application | 0.16 | 0.102 | 0.001 |
| Comparative Example 4 | 37.8 | Grease application | 0.11 | 0.011 | 0.003 |
| Comparative Example 5 | 39.3 | Grease application | 0.11 | 0.012 | 0.005 |
| Comparative Example 6 | 39.9 | Grease application | 0.11 | 0.011 | 0.007 |
| Comparative Example 7 | 40.5 | Grease application | 0.11 | 0.010 | 0.002 |

The mark (*) adjacent to a numerical value indicates that the value is out of the numerical value range of the present invention.

The friction coefficient at the test finish of the plain bearings 11 composed of the aluminum bronze alloys of Examples 1 to 5 used in the present Examples was 0.13 or lower, which was suitable for use of the aluminum bronze alloys as the sliding member. Further since the wear amount of plain bearing 11 composed of the aluminum bronze alloys of Examples 1 to 5 was 0.04 mm or smaller and the Rockwell hardness was HRC17 or higher, the aluminum bronze alloys as the sliding member were excellent in the high-load durability and the wear resistance. By contrast, according to Comparative Examples 1 to 3, as indicated in Table 5, the friction coefficient at the test finish was 0.16 or higher, which was high as compared with in the present Examples 1 to 5, leaving a problem in the sliding performance as compared with Examples 1 to 5. Further according to Comparative Examples 1 to 3, the wear amount of plain bearing 11 at the test finish exceeded 0.08 mm and the Rockwell hardness was lower than HRC17. Since the wear amount of plain bearing 11 was twice or larger than that of each of Examples 1 to 5, Comparative Examples 1 to 3 left a problem in the high-load durability and the wear resistance, and it was difficult for the aluminum bronze alloys to be used in applications as the sliding member. Further in Example 3, the sliding performance depending on presence/absence of a grease was checked (see Table 5). The friction coefficient of the plain bearing 11 in the case where no grease was applied to the plain bearing 11 (0.13) means little change as compared with the friction coefficient of the plain bearing 11 in the case where the grease was applied to the plain bearing 11 (0.11). By contrast, the wear amount of plain bearing 11 in the case where no grease was applied to the plain bearing 11 (0.028 mm) was large as compared with the wear amount of the plain bearing 11 in the case where the grease was applied to the plain bearing 11 (0.015 mm), but was remarkably small as compared with the amount worn of the bearings of Comparative Examples 1 to 3 (0.087 mm to 0.124 mm). Therefore, since irrespective of presence/absence of the lubricant, the sliding member composed of the aluminum bronze alloy of the present invention had excellent sliding performance, the aluminum bronze alloy was suitable for use for the sliding member in the environment where a lubricant cannot be used in a much amount.

Figure 5:
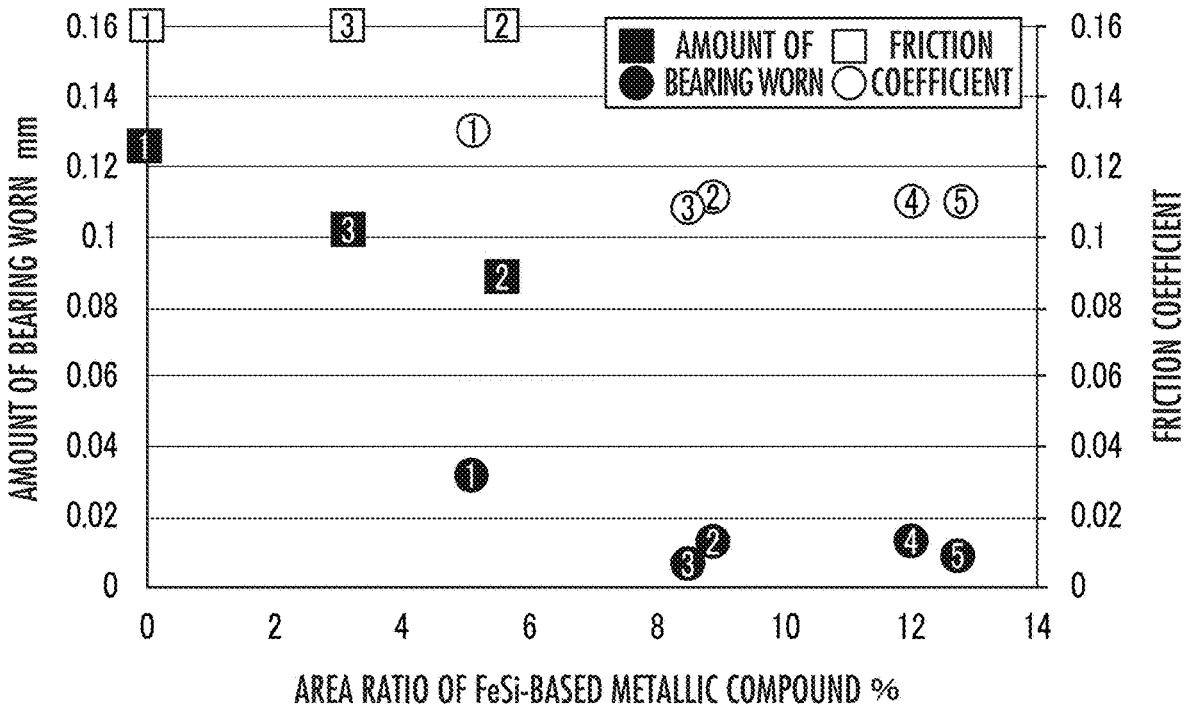
FIG. 5 is a diagram showing relations between the area proportion of an Fe—Si-based intermetallic compound of the aluminum bronze alloy of the present invention, and the wear amount of the bearing and the friction coefficient.

FIG. 5 is a diagram showing relations between area ratios, obtained by calculating area proportions of the Fe—Si-based intermetallic compound with respect to the entirety from optical microscopic photographs showing microstructures of the aluminum bronze alloys of Examples 1 to 5 and Comparative Examples 1 to 3, and the friction coefficients and wear amounts of bearings obtained in Table 5. Here, the axis of abscissa represents the area proportion with respect to the entirety of the Fe—Si-based intermetallic compound; the axis of ordinate on the left side represents the wear amount of bearing; and the axis of ordinate on the right side represents the friction coefficient. Numerical values surrounded by open circles represent the friction coefficients of Examples corresponding to the numerical values; numerical values surrounded by filled circles represent the wear amounts of bearings of Examples corresponding to the numerical values; numerical values surrounded by open squares represent the friction coefficients of Comparative Examples corresponding to the numerical values; and numerical values surrounded by filled squares represent the wear amounts of bearings of Comparative Examples corresponding to the numerical values. In a high surface pressure, generally, since the true contact area increased and the retention of the lubrication film was difficult, therefore the friction coefficient and the wear amount of bearing were likely to increase. In order to prevent this effect, it was needed that the area proportion of the Fe—Si-based intermetallic compound was made high and the true contact area was made small. In particular, with reference to FIG. 5, with the area proportion of the Fe—Si-based intermetallic compound with respect to the entirety of 4% or higher, the effects of the reduction in the friction coefficient and the decrease in the wear amount of the bearing were remarkably exhibited. In the case where the area proportion of the Fe—Si-based intermetallic compound with respect to the entirety was lower than 4%, the friction coefficient became high and the wear amount of the bearing was increased. On the other hand, in the case where the Fe—Si-based intermetallic compound exceeded 14%, wear of the mating shaft became remarkable, and the sliding performance was not retained for a long period. Further, flexibility in processing was restricted depending on the hardness. Therefore, in the aluminum bronze alloy of the present invention, the range of the area proportion of the Fe—Si-based intermetallic compound was preferably 4% or higher and 14% or lower and more preferably 4.7% or higher and 13.2% or lower.

Figure 6:
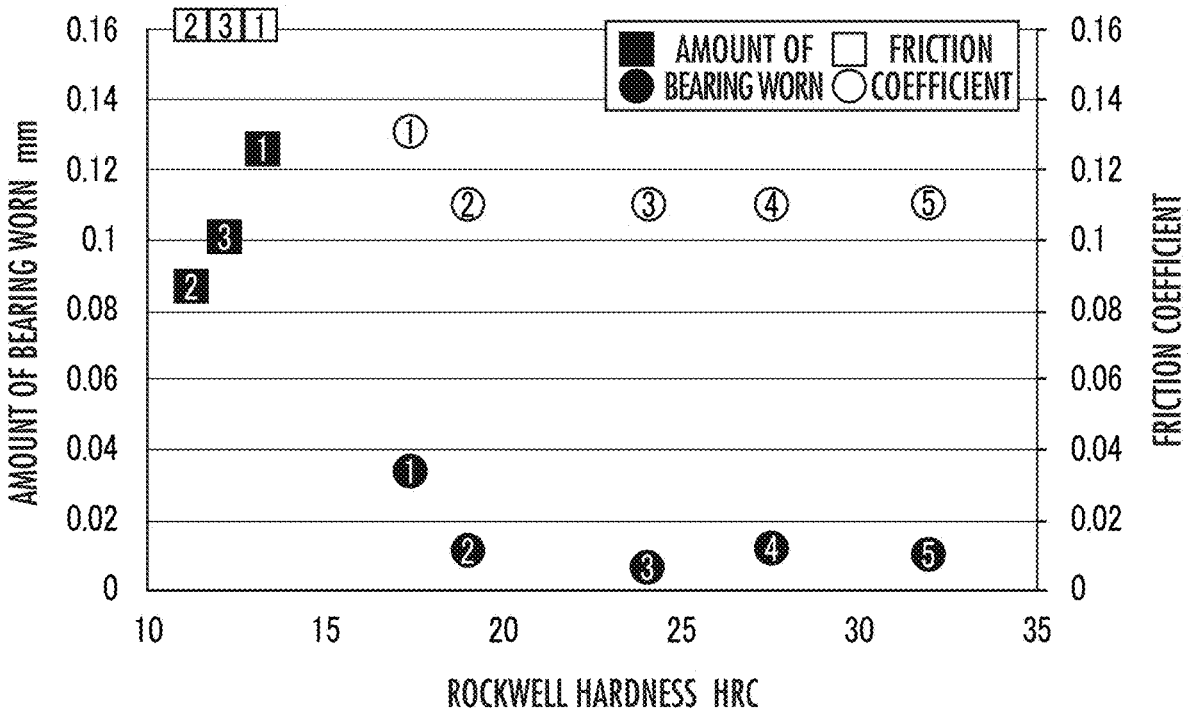
FIG. 6 is a diagram showing relations between the Rockwell hardness of the aluminum bronze alloy of the present invention, and the wear amount of the bearing and the friction coefficient.

FIG. 6 is a diagram showing relations between the Rockwell hardnesses of the plain bearings 11 (see Table 5) composed of the aluminum bronze alloys of Examples 1 to 5 and Comparative Examples 1 to 3, and the friction coefficients and wear amounts of bearings obtained in Table 5. Here, the axis of abscissa represents the Rockwell hardness of the plain bearing 11; the axis of ordinate on the left side represents the wear amount of the bearing; and the axis of ordinate on the right side represents the friction coefficient. Numerical values surrounded by open circles represent the friction coefficients of Examples corresponding to the numerical values; numerical values surrounded by filled circles represent the wear amounts of bearings of Examples corresponding to the numerical values; numerical values surrounded by open squares represent the friction coefficients of Comparative Examples corresponding to the numerical values; and numerical values surrounded by filled squares represent wear amounts of bearings of Comparative Examples corresponding to the numerical values. In a high surface pressure, generally, since the true contact area increased and the retention of the lubrication film was difficult, therefore the friction coefficient and the wear amount of the bearing were likely to increase. In order to prevent this effect, it was needed that the area proportion of the Fe—Si-based intermetallic compound was made high and the true contact area was made small; and in order to prevent falling-off of the Fe—Si-based intermetallic compound, it was needed that the hardness of the base phase was made high. With reference to FIG. 6, with the Rockwell hardness of HRC17 or higher, the effects of the reduction in the friction coefficient and the decrease in the wear amount of the bearing were remarkably exhibited. In particular, in Comparative Examples 1 to 3, since the Rockwell hardness was lower than HRC17, the friction coefficient was in a high level of 0.16 and the wear amount of the bearing was 0.08 mm or larger. Therefore, from the viewpoint that the sliding performance could be retained, in the aluminum bronze alloy of the present invention, the Rockwell hardness was preferably HRC17 or higher and more preferably HRC17.5 or higher.

Hitherto, the present invention has been described based on Examples. According to the aluminum bronze alloy of the present invention, since the dealuminated corrosion depth is small as compared with other aluminum bronze alloys, even in seawater and the environment highly chemically active, the properties as the aluminum bronze alloy and in turn the properties as the sliding member are retained. Further since the aluminum bronze alloy of the present invention has a sufficient hardness and exhibits sufficient performance as the sliding performance in the seawater journal test, the aluminum bronze alloy is a material suitable as the sliding member having the high-load resistance and the wear resistance.

REFERENCE SIGNS LIST

PLAIN BEARING . . . 11, SHAFT . . . 12

The invention claimed is:

1. An aluminum bronze alloy comprising copper (Cu), aluminum (Al), nickel (Ni), iron (Fe), silicon (Si), and inevitable impurities, wherein, with respect to a total weight, Al is 9.5% by weight or more and 10.5% by weight or less;

Ni is 6.0% by weight or more and 8.0% by weight or less;

Fe is 4.0% by weight or more and 6.0% by weight or less;

Si is 1.0% by weight or more and 2.0% by weight or less; and the balance is Cu and the inevitable impurities, and the aluminum bronze alloy has a structure composed of an α phase, a coarse Fe—Si-based intermetallic compound having a shape with a first thickness along a first axis and a second thickness along a second axis that is greater than the first thickness, in which the first thickness is 1 μm or longer, an infinitesimal κ phase different from the Fe—Si-based intermetallic compound having a first length and a second length that is longer than the first length in which the first length is less than 1 μm, and a trace amount of inevitable phases;

the coarse Fe—Si-based intermetallic compound accounts for 4% or higher and 14% or lower with respect to an entire structure in terms of area ratio in a cross-section of the metal; and the infinitesimal k phase is formed dottedly or linearly and dispersed in the entire structure.

2. The aluminum bronze alloy according to claim 1, wherein, with respect to the total weight, Al is 9.5% by weight or more and 10.5% by weight or less;

Ni is more than 7.0% by weight and 8.0% by weight or less;

Fe is 4.0% by weight or more and 6.0% by weight or less;

Si is 1.0% by weight or more and 2.0% by weight or less; and the balance is Cu and inevitable impurities.

3. The aluminum bronze alloy according to claim 1, wherein the aluminum bronze alloy has a Rockwell hardness of HRC17 or higher.

4. The aluminum bronze alloy according to claim 1, wherein, in a corrosion test method according to ISO6509-1981, a maximum dealuminated corrosion depth is 120 μm or smaller.

5. A sliding member, having a sliding surface formed of the aluminum bronze alloy according to claim 1.

6. The sliding member according to claim 5, wherein a plurality of holes, grooves or recesses are formed on the sliding surface, and a solid lubricant is embedded and fixed in the holes, grooves or recesses.

7. The sliding member according to claim 5, wherein part of or an entirety of the sliding member is used in seawater.

8. The aluminum bronze alloy according to claim 1, wherein the first and second directions are perpendicular to one another, and wherein the third and fourth directions are perpendicular to one another.

9. The aluminum bronze alloy according to claim 1, wherein the first direction and the third direction are different than one another.

10. The aluminum bronze alloy according to claim 1, wherein the Fe—Si-based intermetallic compound has a generally oval shape with a major diameter extending in the second direction and a minor diameter extending in the first direction.

11. The aluminum bronze alloy according to claim 1, where the shape is substantially oval.

* * * * *